United States Patent [19]

Lewis et al.

[11] 4,183,172

[45] Jan. 15, 1980

[54] TOY WITH ENDLESS BELT FOR CONVEYING A DOLL OR THE LIKE

[75] Inventors: J. Stephen Lewis, Pacific Palisades; Jurgis Sapkus, Manhattan Beach, both of Calif.

[73] Assignee: Mattel, Inc., Hawthorne, Calif.

[21] Appl. No.: 833,758

[22] Filed: Sep. 16, 1977

[51] Int. Cl.[2] ..... A63H 11/00

[52] U.S. Cl. ..... 46/122; 46/140; 40/415

[58] Field of Search ..... 46/122, 13, 140, 116, 46/119; 273/86 F; 40/415

[56] References Cited

U.S. PATENT DOCUMENTS

| | | | |
|---|---|---|---|
| 1,984,948 | 12/1934 | Sigsbee | 40/415 X |
| 2,066,239 | 12/1936 | Tahsler | 46/122 X |
| 2,228,610 | 1/1941 | Reid | 46/13 X |
| 3,552,322 | 1/1971 | Clowes | 104/172 |
| 3,605,305 | 9/1971 | Grigorian | 40/415 |

FOREIGN PATENT DOCUMENTS

| | | | |
|---|---|---|---|
| 304015 | 12/1932 | Italy | 40/415 |
| 237727 | 8/1925 | United Kingdom | 40/415 |

*Primary Examiner*—Louis G. Mancene
*Assistant Examiner*—Mickey Yu
*Attorney, Agent, or Firm*—John G. Mesaros; Max E. Shirk; Ronald M. Goldman

[57] ABSTRACT

A toy for supporting and conveying a doll or the like utilizing a doll carrier member rotatably coupled to a link of a continuous endless belt disposed within a channel beneath a platform having a continuous slot for passage therethrough of a portion of the doll carrier. The doll carrier includes a geared disc member with an integral triangular cam member, the disc member engaging a rack member within the channel to cause the doll to pirouette or turn with the cam member alternately engaging oppositely disposed spaced fixed cams to cause the doll to walk. The belt is motor driven and reversible and upon reversing, the cam structure causes the doll carrier to reverse directions.

9 Claims, 7 Drawing Figures

TOY WITH ENDLESS BELT FOR CONVEYING A DOLL OR THE LIKE

BACKGROUND OF THE INVENTION

The background of the invention will be discussed in two parts:

1. Field of the Invention

This invention relates to toys and more particularly to a toy having a housing with a platform with a slot below which is a driven continuous endlesss belt with a supporting member for supporting a body above the platform for movement thereon.

2. Description of the Prior Art

Toys utilizing continuous endless belt drive members operable within a channel beneath a platform to drive an object such as a vehicle or the like on the platform are exemplified by U.S. Pat. No. 3,552,322 in which the drive member is in the form of a chain having a plurality of beads interconnected by flexible links, the chain so-formed being operable within a channel to move a toy vehicle on a surface immediately above the channel.

The use of such continuous loop drive members to provide animation to other bodies, such as toy figures including horses, dolls or other animals are shown in U.S. Pat. Nos. 525,596; 885,350; 1,816,471; 2,784,525; and 2,874,513. In U.S. Pat. No. 525,596 a figure such as a riding horse is provided with a cam roller operating over a vertically disposed sinusoidally configured cam surface, the horse being pivotally secured to a member coupled to a chain to thereby pivot the horse about a horizontal axis. In a second embodiment, a boat is provided with rollers engaging vertically disposed lugs which cause the boat to pivot or rock about a horizontal axis. This patent as well as the above mentioned patents provides animated movement of the supported figure in various ways, which are elaborate in constructon, or limited in versatility of movement of the so-carried figure due to the connection with the belt, or unidirectonal in operation.

Accordingly, it is an object of this invention to provide a new and improved toy utilizing an endless belt for conveying a doll or the like.

It is another object of this invention to provide a new and improved toy utilizing a reversible drive means for driving a belt supporting a doll or the like, and reorienting the doll in response to the reversal of the drive member.

SUMMARY OF THE INVENTION

The foregoing and other objects of the invention are accomplished by providing a toy having a housing with a platform with a continuous slot therein with a channel formed within the housing in general alignment beneath the slot for receiving a continuous endless belt drive member and reversible motor-operated drive means therefore. A doll carrier is rotatably coupled to the belt, the doll carrier including a circular gear member and a triangular cam member. The path of travel of the doll is generally triangular with three straight pathways connected by two acute angles and one obtuse angle. Rack means are secured within the channel adjacent the intersections of the straight pathways for engaging the circular gear member to rotate the doll carrier. A plurality of generally horizontally extending cam surfaces are formed within the channel, the cam surfaces being alternately disposed on opposite sides of the channel for alternatelly engaging the triangular cam member to oscillate the doll carrier, the cam arrangement be so configured that upon reversal of the drive member the doll carrier with the doll thereon will face in the opposite direction, that is, in the direction of travel of the drive member.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
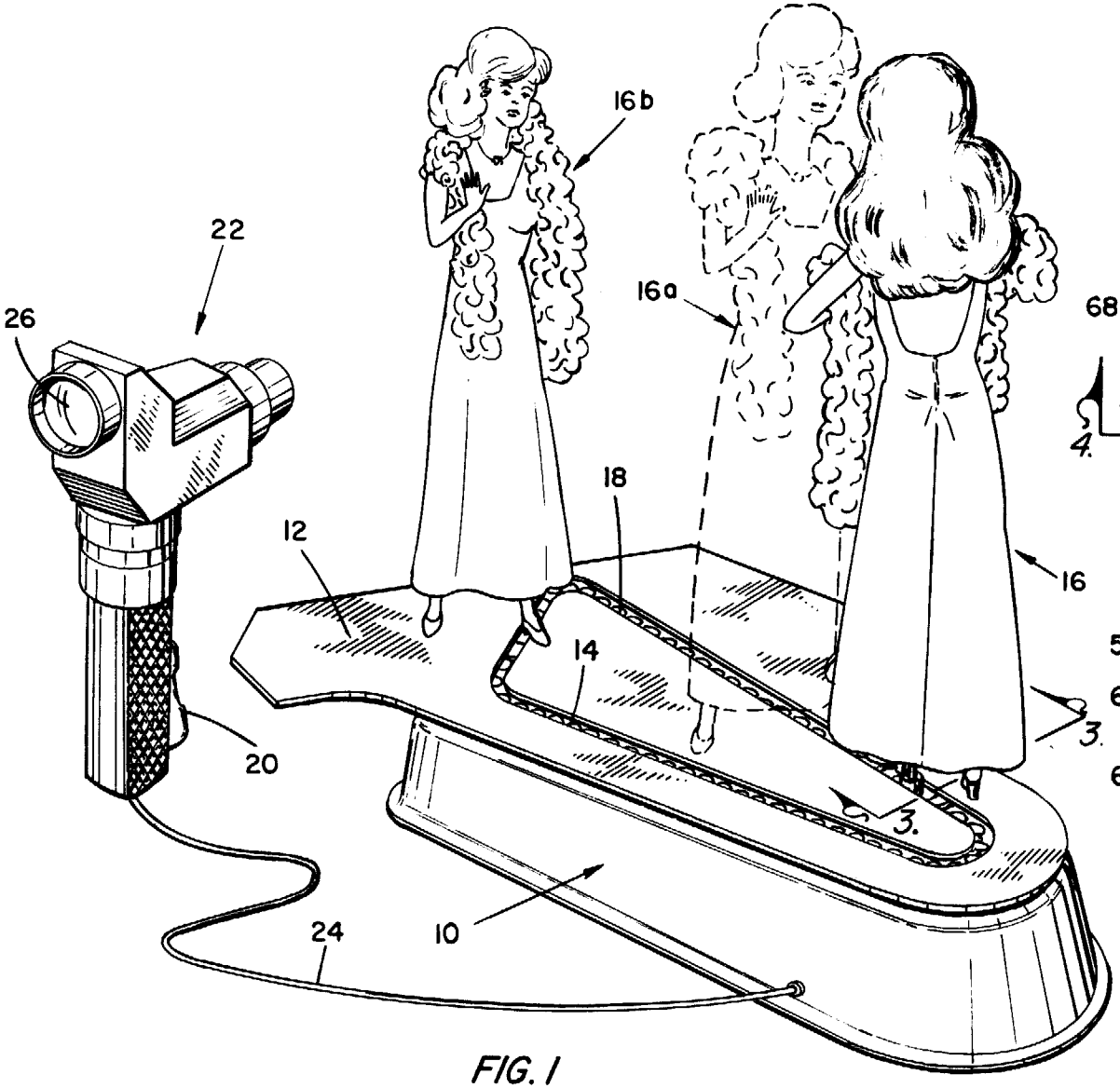
FIG. 1 is a perspective view of the toy illustrating a doll at various positions along the pathway and further illustrating a camera containing the switch means for driving the belt.

Referring now to the drawings and particularly to FIG. 1, there is shown a toy in accordance with the invention, the toy including a housing generally designated 10 having a generally planar platform thereon, the housing 10 being configured for resting on a suitable supporting surface with the platform 12 in a generally horizontal plane. The platform 12 is provided with a continuous triangular slot 14 for defining a pathway for travel of a supported body such as a doll generally designated 16, or the like. The toy is adapted for supporting and conveying the doll 16 about the pathway defined by the slot 14 by means of a continuous endless belt drive member 18 operably disposed within a channel beneath the platform 12 as will hereinafter be discussed. The toy is motor-operated and electrically controlled by means of a switch 20 in the handle of a toy camera generally designated 22, the switch 20 being electrically connected by means of a suitable electrical cord 24. As will hereinafter be discussed, in using the toy, the child observes the doll 16 through a lens system 26 of the camera 22, and by actuation of the switch 20, the child can start, stop and reverse the belt 18 to control the movement of the doll 16 about the platform 12.

Figure 2:
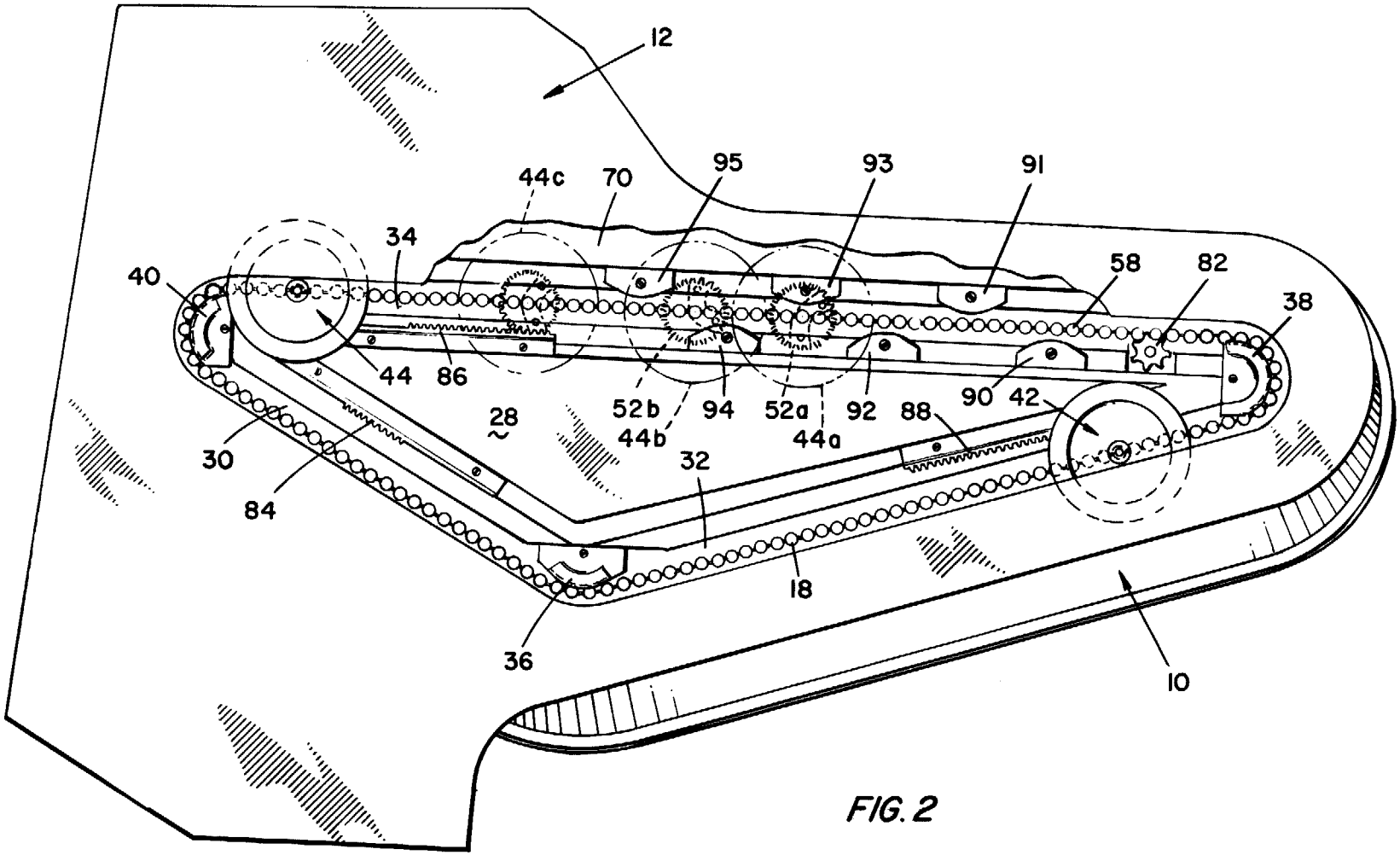
FIG. 2 is a plan view of the platform of the toy of FIG. 1 with part of the cover removed and partially broken away showing the continuous endless belt.

Referring also to FIG. 2, in that FIGURE the triangular portion of platform 12 which defines the periphery of slot 14 has been removed to show the interior working components of the drive system. The housing 10 is configured internally with a raised centrally disposed portion 28 of triangular configuration having the sidewalls thereor, in conjuncton with other sidewalls within housing 10, defining channel portions 30, 32 and 34, which collectively form a continuous channel in which is disposed the continuous endless belt 18. The endless belt is formed of a plurality of identical cylindrical bodies (see also FIG. 5), each of the bodies being interconnected by a flexible link to define an endless chain or belt. The belt 18 is suspended within the channel by means of generally horizontally extending belt suspending members 36, 38 and 40 secured at the juncture of each of the channel portions 30, 32 and 34, respectively, each of the belt suspending members having an arcuate groove formed therein for retaining the belt 18 in spaced alignment generally centrally with respect to the channel portions. The grooves are so configured that the central portion of each of the cylindrical body members is outside the edge thereof to enable one of the two doll carrier members 42 and 44 to clear the belt suspending members during movement of the drive member, that is, the continuous endless belt 18.

Figure 3:
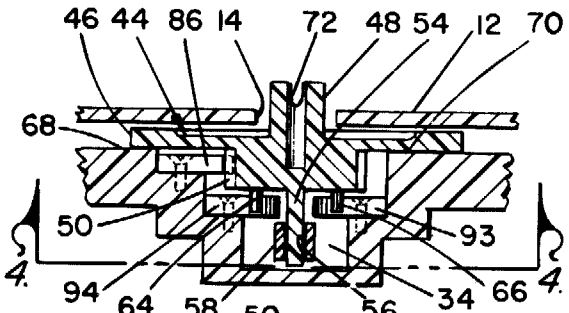
FIG. 3 is a cross-sectional view of the doll carrier taken generally along line 3—3 of FIG. 2.
Figure 4:
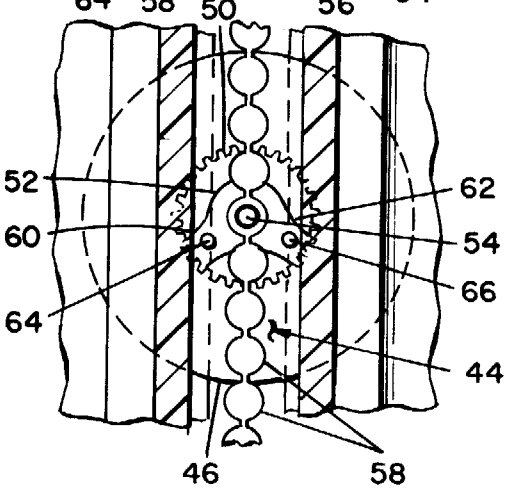
FIG. 4 is a bottom plan view of the doll carrier member as viewed generally along line 4—4 of FIG. 3.

As illustrated in FIGS. 2–4, the doll carrier member 44 includes a circular disc portion 46 with a centrally disposed upwardly extending hub portion 48 configured for extending through the slot 14 in the platform 12, the lower end of disc portion 46 having integral therewith or affixed thereto a circular gear member 50 having a diameter smaller than the distance between opposing walls of channel 34. Also integral with, or affixed to, the gear member 50 is a cam member 52 which is, generally speaking, a triangular cam member. A shaft pin 54 passes through a part of the hub portion 48, through the gear member 50 and through the cam member 52 with a portion of shaft 54 depending below the surface of cam member 52, the depending portion of shaft 54 being rotatably inserted within an aperture 56 formed through one of the cylindrical bodies 58 of the continuous belt 18, the engagement being such that the doll carrier member 44 is rotatably coupled within one body 58 of the belt 18.

The cam member 52 has first and second radially outwardly extending arms 60 and 62, each of which is provided with a downwardly depending pin 64 and 66, respectively, each of the pins being of a length shorter than the distance between the lower surface of cam member 52 and the adjacent upper surface of body 58 to enable the doll carrier 44 to be rotated through 360 degrees without interference. As best illustrated in FIG. 3, the channel 34 is provided on opposite sides thereof with shoulders 68 and 70 which slidingly engage the undersurface of disc portion 46 of doll carrier 44 to provide a wide area of stability for supporting a doll as will hereinafter be described.

Figure 5:
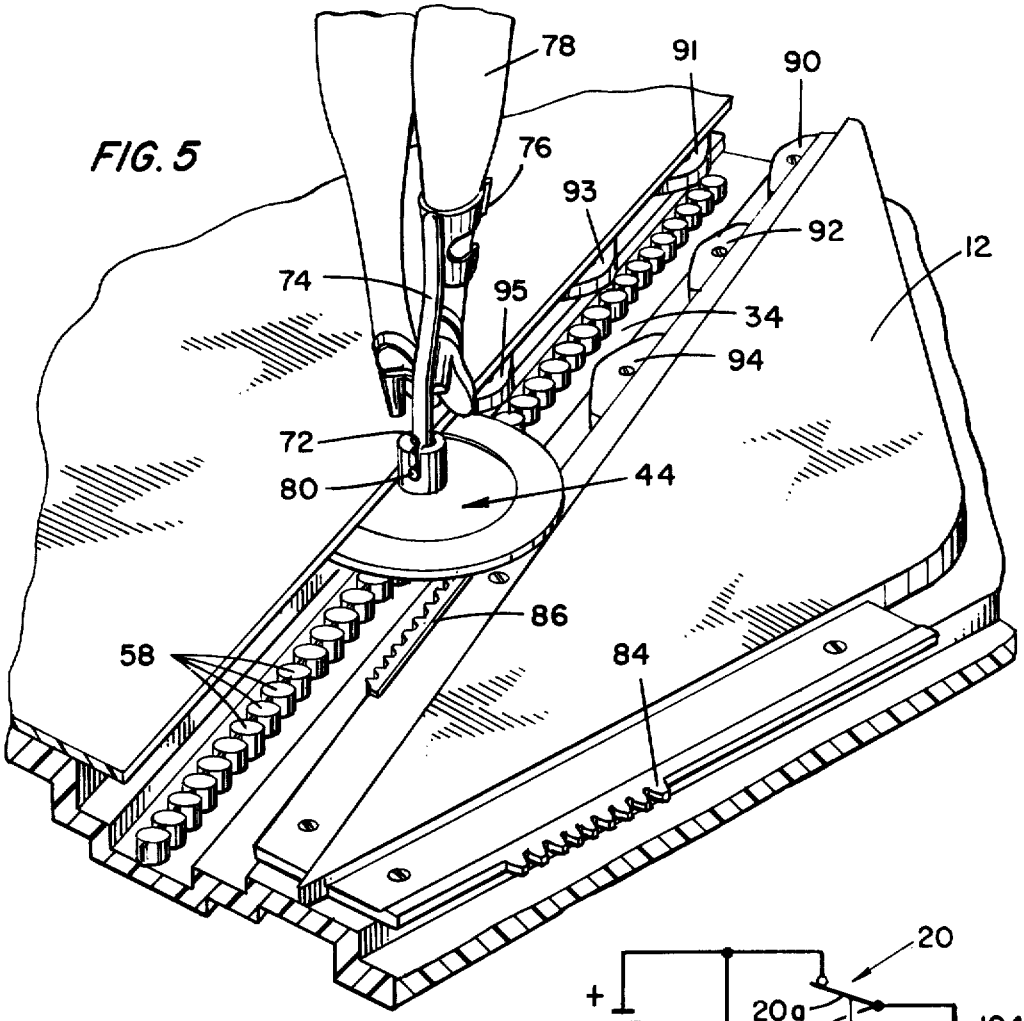
FIG. 5 is an enlarged perspective view of a portion of the platform with a portion of the platform removed to show the doll carrier and the relation to the cam surfaces.

The hub portion 48 has the part thereof within slot 14 configured, as illustrated in FIGS. 3 and 5, with a centrally disposed aperture and a radially extending slot 72 for fixedly receiving a leg supporting member 74 having a clip portion 76 for engaging the lower portion of one leg 78 of doll 16 for maintaining the doll 16 in a generally upright position. The leg supporting member 74 has the lower end thereof in the form of a rod with s radially extending pin 80 matingly engaging slot 72 to fix the angular orientation of leg supporting member 74 with respect to the doll carrier 44. The leg supporting member 74 is fully shown and described in U.S. Patent applicaton Ser. No. 814,022 entitled, "DOLL STAND" by Jurgis Sapkus, et al. filed July 8, 1977 and assigned to the assignee of the instant invention. Further discussion thereof is deemed unnecessary, but the leg supporting member 74 supports the doll 16 in a fixed generally upright position relative to the doll carrier 44, with the rotation of the disc portion 46 of doll carrier 44 correspondingly rotating or pivoting the doll 16.

Referring again to FIG. 2, the endless belt 18 is driven by a drive sprocket gear member 82 positioned adjacent the juncture of channel portions 32 and 34, the sprocket member 82 having arcuately configured teeth portions adapted to matingly engage the adjacent surface of each of the cylindrical body members 58, rotation of sprocket 82 thereby driving the endless belt 18 along with, of course, the doll carriers 42 and 44 which, are spaced equidistant along the length of belt 18 for supporting one or two dolls 16 as desired. For this purpose, it is to be emphasized that the leg supporting member 74 is removable from the hub portion 48 of doll carrier 44, and likewise, doll carrier 42, both of the doll carriers being identically configured. Positioned in proximity to each of the channel portions 30, 32 and 34 are doll carrier rotating or oscillating members, these being three rack members 84, 86 and 88, respectively, and 6 cam members 91–95, inclusive, each of the doll carrier direction changing members being generally horizontally disposed for abuttingly or meshingly engaging one of the coacting portions of the doll carrier members 42 and 44. For reference purposes, the direction of movement of belt 18 within the channel will be described with reference to a counterclockwise movement, athough as will hereinafter be discussed, the belt 18 can correspondingly be reversed for traversing clockwise rotation as viewed in FIG. 2.

The doll carrier 44 is illustrated adjacent belt suspending member 40 at the juncture of the pathways defined by channel portions 30 and 34. As the belt 18 travels in a counterclockwise direction the doll carrier 44 passes around belt suspending member 40 until a short distance later the gear member 50 thereof meshingly engages the gearteeth of the first rack member 84 which is so-configured and so-positioned to cause the doll carrier 44 to effect an amount of rotation determined by the number of gearteeth on rack 84, the number of teeth on rack 84 in conjunction with the number of teeth on rack 86 effecting one complete revolution of the doll carrier 44, with the rack 86 effecting two-thirds of the revolution and rack 84 effecting the remaining one-third of the revolution. As the doll carrier 44 continues in its counterclockwise movement, channel portion 30 is traversed until the doll carrier 44 passes belt suspending member 36 to enter channel portion 32 until the gear member 50 engages the rack 88 to pirouette the doll, or rotate the doll carrier 44 through a complete revolution. With the doll 16 initially facing in the direction of travel of doll carrier 44, at the conclusion of the meshing engagement of the gear member 50 with the rack 88 the doll 16 will continue to face in the same direction. The doll carrier 44 then passes belt suspending member 38 to pass sprocket 82 until a first cam member 90 is reached.

As illustrated, the camming arrangement provides a first set of cams 90, 92 and 94 equally spaced within channel portion 34 adjacent shoulder 68 with a second set of identically configured cam surfaces 91, 93 and 95 being positioned with equal spacing therebetween adjacent shoulder 70, with the second set of cams being offset half the distance between the first set of cams. As the doll carrier 44 passes over each of the first set of cams, the depending pin 64 of cam member 52 abuttingly engages the edge of cam 90 to thereby rock or oscillate the doll carrier 44 in a counterclockwise directon through an angle determined by the spacing of pin 64 relative to the shaft 54 of doll carrier 44 and further determined by the face of cam 90. As the doll carrier increments a step further with movement of belt 18, the doll will be facing to its left until the depending pin 66 of the other arm 62 of cam member 52 intercepts the cam surface of the first cam 91 of the second set of cams to thereby rotate or pivot the doll carrier 44 along with, of course, the doll 16 carried thereby in a clockwise direction through generally the same angle of movement. This sequence is then repeated as illustrated by the dotted line depictions of the cam members designated 52a and 52b unitl the cam member 52 of doll carrier 44 passes the last cam 95, at which point the doll 16 supported by doll carrier 44 will be facing generally forward. As the doll carrier 44 traverses the final increment of channel portion 34, the gear member 50 thereof meshingly engages the teeth of rack member 86 to rotate doll carrier 44 through approximately two-thirds of a revolution.

If the doll carrier 44 is in the dotted line position designated 44a and the belt 18 is reversed in direction to traverse a clockwise path, the V-shaped or triangular configuration of cam member 52 relative to the first and second set of horizontally disposed cam surfaces effects a rotation of doll carrier 44 until the doll 16 is facing the direction of travel. This is due to the approximately 120 degree angular displacement between depending pins 64 and 66 relative to the center of doll carrier 44. For the first increment of travel the doll carrier 44 will maintain its alignment until pin 66 engsges cam surface 95 at which point the doll carrier 44 will be rotated in a counterclockwise direction. The depending pins 64 and 66 of cam member 52 will then bypass cam 94 until pin 64 engages cam 93 to complete the movement of doll carrier 44 until it is facing generally in the direction of travel of belt 18 whereupon the pins alternately engage cams 92, 91 and 90 in that order thereby oscillating doll carrier 44 during this portion of the travel of belt 18. Correspondingly, the doll carrier 44 will have the gear member 50 thereof engaging the rack members 88, 84 and 86 in that order. This rotational movement is also illustrated by the dotted line depiction of the doll designated 16a with the doll 16b illustrating the relative position of a second doll carried by doll carrier 42 in the event the two doll configuration is utilized by the child.

The surface of platform 12 as shown in FIGS. 1 and 2 has an enlarged wing-shaped rear portion, the intent being to provide a prop setting for the toy including curtain members concealing this wing-shaped portion to thereby simulate a fashion show or the like wherein the doll enters from behind a curtain and exits through a curtain with corresponding fashion model posing and pirouetting movements being effected during traversal of the doll over the exterior portion of the stage or platform 12. With a curtain in position, the racks 84 and 86 are configured to cause the doll 16 to enter the opening sideways to prevent the grasping of the curtain by the arms of the doll.

Figure 7:
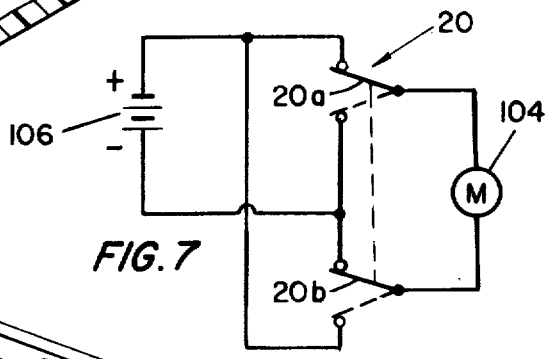
FIG. 7 is a schematic diagram of the reversible motor circuit.
Figure 6:
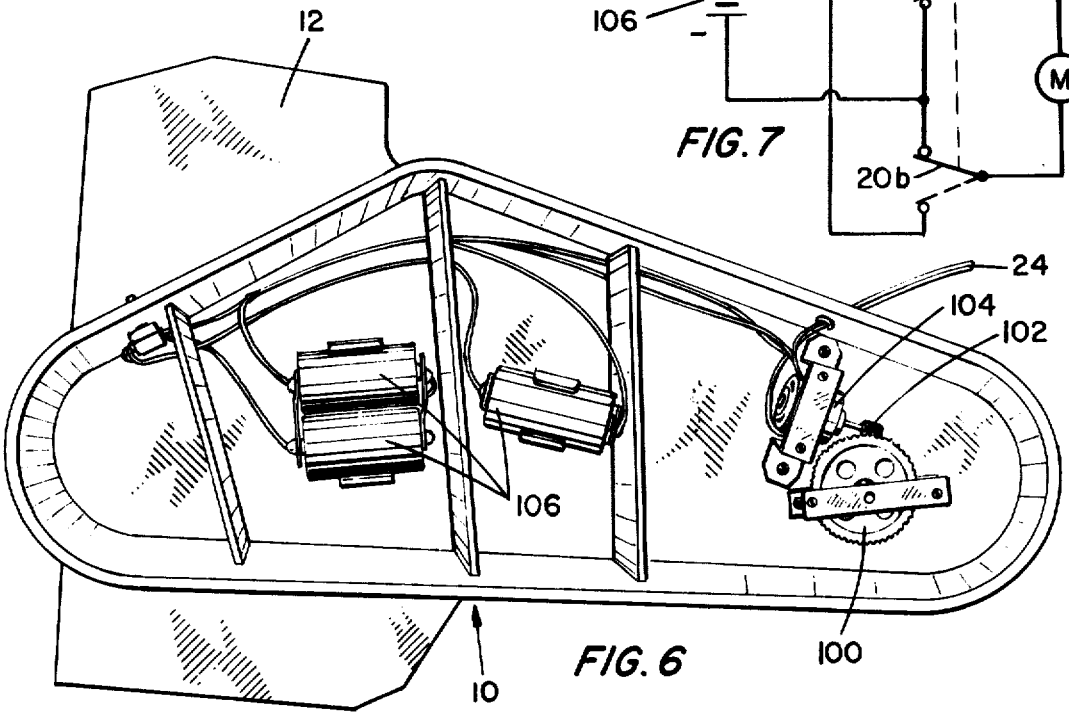
FIG. 6 is a bottom plan view of the housing and platform of FIG. 2.

The driving of the belt 18, as above-mentioned is accomplished directly by means of sprocket 82 which is coupled through a gear member 100 (see FIG. 6) driven by a worm gear 102 secured to the shaft of an electrical motor 104, the motor 104 being electrically coupled to batteries 106 for energization thereof. The batteries 106 along with the motor 104 and the drive gears 100 and 102 are suitably secured in convention fashion within housing 10 beneath the platform 12, the housing 10 having a generally hollow interior for containing the parts. As illustrated in FIG. 7, the batteries 106 are electrically coupled to motor 104 through a reversing switch 20 having first and second simultaneously actuated movable contact members 20a and 20b operated by the switch 20 of camera 22 shown in FIG. 1. The switch 20 is essentially a slide switch having a neutral or stop position wherein the contacts 20a and 20b are intermediate stationary contacts associated therewith with one set of stationary contacts providing a first polarity to the reversibly direct current motor 104 and the other pair of stationary contacts providing the opposite polarity to the motor 104. The electrical arrangement illustrated in FIG. 7 is conventional as is switch 20 and well known to those skilled in the art, the essential portion as applied to the instant invention being the provision of reversible drive means to drive the belt 18 in either direction.

Summarizing the operation of the toy, a child takes the doll 16, the doll 16 being of the type generally referred to as a posable fashion doll having bendable and pivotable limbs, the leg supporting member 74 then being affixed to the leg 78 of the doll. The leg supporting member 74 is then suitably inserted into slot 72 with the aligning pin 80 coacting therewith to position the leg supporting member 74 in fixed relation to the doll carrier 44. Assuming the doll carrier 44 is out of engagement with any of the rack members, it can then be rotated until the doll 16 is facing in the intended direction of travel of the belt 18. The child utilizing the camera 22 then views the doll 16 through the lens 26 of the camera 22 of "film" the action and by selectively controlling the switch 20, the child can then drive the doll 16 in the given direction, cause it to stop or cause it to reverse directions as desired. The doll 16 will then traverse three straight line paths forming overall, a triangular closed loop path defined by slot 14 with animated fashion posing occurring at prescribed points along the path of travel. As the doll carrier 44 traverses the first increment within channel portion 30, a partial revolution of the doll carrier 44 along with doll 16 will occur until the doll is facing in the directon of the doll 16b of FIG. 1. During the second increment of travel defined by channel portion 32 the doll will effect one complete revolution, that is, a pirouette when the gear member 50 of doll carrier 44 engages rack portiin 88. During the last increment of travel of belt 18 within channel portion 34 and the belt moving in a counterclockwise direction as illustrated in FIG. 1 the doll 16 will be facing down stage with oscillating movement occurring during interception of cam member 52 by the alternately disposed facing sets of cams beneath the platform 12. If at this point, the child so desires, the doll can be rotated to the dotted line position 16a to face upstage, that is, toward the V-shaped part of platform 12 with the oscillating intermittent movement of doll 16 simulating the left-stop then right-stop of a fashion model while posing before an audience. Consequently, the toy hereinabove described utilizes an endless loop belt driven by a reversible motor, the belt having provision for rotatably receiving a doll carrier member having affixed or secured thereto a gear member for coacting with fixed rack gears to effect rotation of the doll carrier, and a cam member for intermittently oscillating (and rotating, if the drive belt direction is reversed) the doll carrier when contacted by fixed alternately spaced oppositely disposed horizontal cam projections, the rotation and oscillatiin of the doll carrier along with the doll being effected about an axis generally perpendicular to the plane of the platform 12. During this movement the stability of the doll 16 supported by the leg supporting member 74 is assisted by the enlarged peripheral surface of the disc portion 46, the undersurface of which is in sliding abutting engagement with the generally horizontally disposed shoulder portions 68 and 70 on either side of the channel within which the belt 18 moves. While there has been shown and described a preferred embodiment, it is to be understood that various other adaptations and modifications may be made within the spirit and scope of the invention.

What is claimed is:

1. In a toy for supporing and conveying a doll or the like, the combination comprising:

a housing having a platform, the housing being configured for supporting the platform generally parallel to a supporting surface;

channel means within said housing in proximity to said platform, said channel means defining a closed loop path;

a continuous endless belt drive member within said channel means;

slot means within said platform in spaced aligned relation with said drive member;

a carrier rotatably coupled to said drive member beneath said platform for supporting a doll or the like above said platform, said carrier including a gear portion and a cam device;

rack means within said channel means positioned for meshingly engaging said gear portion for rotating said carrier;

first and second sets of equally spaced cam members within said channel means on opposite sides of said drive member, one set of said cam members being displaced from the other set in the direction of travel of said drive member a distance of approximately one-half the spacing, said cam device being so configured and so positioned for alternately engaging said cam members for oscillating said carrier during movement of said drive member; and reversable drive means coupled to said drive member, said cam device being further configured for engaging the first of said cam members in the reverse direction of travel to rotate said carrier approximately one-half turn for rotating a so-supported doll to face in the opposite direction.

2. The combination according to claim 1 wherein said cam device has cam means thereon offset from the axis of rotation of said carrier.

3. The combination according to claim 2 wherein said cam means include a pair of cam pins angularly spaced relative to each other, said cam pins engaging said cam members.

4. The combination according to claim 3 wherein said continuous endless belt drive member includes a chain member formed of a plurality of cylindrical bodies interconnected by flexible link means, and said carrier is rotatably coupled to one of said cylindrical bodies.

5. The combination according to claim 4 wherein said channel means includes shoulder means on opposite sides thereof, said shoulder means forming a plane for supporting said carrier in generally sliding abutting relation whereby to provide stability for the supported doll or the like.

6. The combination according to claim 1 wherein said carrier includes coupling means for securing a doll or the like thereto in fixed relation to said carrier.

7. The combination according to claim 6 wherein said coupling means is a leg supporting member having clip means for securing to one leg of a doll or the like.

8. The combination according to claim 7 wherein said toy includes two carriers rotatably coupled to said drive member, said carriers being generally equally spaced along the length of said carrier.

9. The combination according to claim 1 wherein said reversable drive means includes an electrically operated motor.

* * * * *